US007901735B2

(12) United States Patent
Foerster et al.

(10) Patent No.: US 7,901,735 B2
(45) Date of Patent: Mar. 8, 2011

(54) METHOD FOR CONTINUOUS COATING OF AN INSIDE OF A CONTINUOUSLY EXTRUDED HOLLOW PROFILE STRAND OF ELASTIC MATERIAL

(75) Inventors: Dieter Foerster, Gross-Umstadt (DE); Juergen Krautter, Riedstadt (DE); Manfred Schneider, Alsbach-Haehnlein (DE)

(73) Assignee: Evonik Rohm GmbH, Darmstadt (DE)

( * ) Notice: Subject to any disclaimer, the term of this patent is extended or adjusted under 35 U.S.C. 154(b) by 1214 days.

(21) Appl. No.: 10/585,876

(22) PCT Filed: Dec. 24, 2004

(86) PCT No.: PCT/EP2004/014709

§ 371 (c)(1),
(2), (4) Date: Jul. 11, 2006

(87) PCT Pub. No.: WO2005/072882

PCT Pub. Date: Aug. 11, 2005

(65) Prior Publication Data

US 2009/0191335 A1 Jul. 30, 2009

(30) Foreign Application Priority Data

Jan. 29, 2004 (DE) ..... 10 2004 004 679

(51) Int. Cl.

| | |
|---|---|
| ***B05D 7/22*** | (2006.01) |
| ***B05D 3/12*** | (2006.01) |
| *B05C 7/04* | (2006.01) |
| *B05C 7/06* | (2006.01) |
| *B05C 7/08* | (2006.01) |

(52) U.S. Cl. ..... 427/235; 427/355; 427/434.2

(58) Field of Classification Search ..... 427/230–239, 427/355, 356, 359, 434.2; 118/DIG. 10, 118/DIG. 12, DIG. 13, 419, 420, 423, 105
See application file for complete search history.

(56) References Cited

U.S. PATENT DOCUMENTS

| | | | | |
|---|---|---|---|---|
| 2,100,587 | A * | 11/1937 | Chalker | 118/105 |
| 3,732,625 | A * | 5/1973 | Vernooy | 33/777 |
| 3,862,497 | A * | 1/1975 | Vernooy et al. | 33/777 |
| 4,393,805 | A * | 7/1983 | Boer | 118/105 |

FOREIGN PATENT DOCUMENTS

| | | |
|---|---|---|
| EP | 0 530 617 | 3/1993 |

(Continued)

*Primary Examiner* — William Phillip Fletcher, III
(74) *Attorney, Agent, or Firm* — Oblon, Spivak, McClelland, Maier & Neustadt, L.L.P.

(57) ABSTRACT

A method for continuously coating the inside of a continuously extruded hollow profiled bar made of elastic material and a liquid wiper and a device for removing excess coating agent from the chambers of a hollow profiled member. A hollow profiled bar is directed through a stationary supply of a liquid coating agent on a bent, arc-shaped track, whereby inner walls of the hollow profiled bar are moistened with coating agent, and the hollow profiled bar is guided along a rising track directly after running through the coating agent supply. Excess coating agent is wiped off one or plural inner walls with the aid of liquid wipers mounted inside the hollow chambers, the hollow profiled bar being continuously moved relative to the liquid wipers. The liquid wipers include at least one magnet or magnetizable material and a wiping lip that touches the inner walls while being located downstream of the coating agent supply in a zone of a sloped track of the hollow profiled bar. The liquid wipers are retained in a steady position within the track of the hollow profiled bar with the aid of counter magnet or magnetizable materials that are fixed next to the outer surface of the continuous hollow profiled bar.

13 Claims, 4 Drawing Sheets

FOREIGN PATENT DOCUMENTS

| | | | |
|---|---|---|---|
| EP | 0 530 617 A1 * | 3/1993 | |
| GB | 1 397 542 | 6/1975 | |
| JP | 2009479 | 1/1990 | |
| JP | 06-063504 A * | 3/1994 | |

* cited by examiner

METHOD FOR CONTINUOUS COATING OF AN INSIDE OF A CONTINUOUSLY EXTRUDED HOLLOW PROFILE STRAND OF ELASTIC MATERIAL

BACKGROUND OF THE INVENTION

I. Field of the Invention

The present invention relates to a method for the continuous coating of the inside of an extruded hollow profile strand. The invention also relates to a device for removing excess coating agent from the chambers of a hollow profile.

II. Description of Related Art

For certain applications, such as for example the glazing of greenhouses or other humid enclosures, twin-wall sheets made of thermoplastic polymers, on the insides of which a water-spreading coating is applied, are used. For example, EP 0 530 617 A1 describes a method for the continuous coating of the inside of an extruded hollow profile made of thermoplastic polymer. In that method, directly after extrusion, a hollow profile strand is guided on a curved path through a supply of a liquid coating agent. After running through the coating agent, the twin-wall strand is guided upward until the entrained excess of liquid coating agent has partly run back into the supply.

One problem of this method is the slow run-off rate of the coating agent. As a result, more coating agent remains in the hollow chambers of the strand than is required for the formation of a uniform film on the inner walls. Such an excess leads to the formation of relatively thick and slow-drying films or else to the formation of flow edges, streaks and so-called "flow noses". As a result, the sheets sawn from the hollow profile are wet.

Although the sawn sheets are treated at 60° C. in a conditioning oven for the purpose of applying an outer laminating film, this treatment is not adequate to remove excess coating agent. The previous solution was to place the sheet onto a carriage with running wheels, which tips the sheet in transverse and longitudinal directions, whereby some of the remaining liquid runs off.

Since the remaining residue of liquid is still very great, the sheets are subsequently connected to a hot-air fan, it being possible for the sheets to be dried individually in a discontinuous process. With the usual amounts of coating liquid, after this process crystalline deposits remain in the hollow profile, occurring as white spots, especially on both end faces of the sheet. To remove these remains, 300 mm must be sawn off on both sides of the sheet and form waste material.

Sawdust produced as a result must in turn be removed from the sheet. This step negates the advantages of the previously performed non-cutting operation of severing after scoring. It is also disadvantageous that remains of liquid or crystalline deposits get under the previously applied laminating film on the outer sides of the sheets and cause it to come away.

An amount of liquid coating agent inside the sheet in excess of the amount required for the formation of a uniform film therefore has the result that the continuous extrusion and coating process has to be followed by discontinuous, laborious reworking steps and that reject fabrication with 6-10% material wastage has to be accepted.

U.S. Pat. No. 5,681,390 describes a spray booth for the spray coating of objects, the inner walls of which are cleaned of finely distributed material by wiping bars. The wiping bars on the inner walls are moved from the outside by means of magnets.

Similar systems are used as magnetic window cleaners for aquariums. In those systems, a cleaning magnet on the inside is guided along the window by means of a magnet on the outside, whereby the inside is cleaned. However, the known techniques do not involve continuous methods. The principle of wiping off the contaminants is based on the idea that the wiper is moved while the location on the workpiece that is to be worked is stationary. Moreover, they are only suitable for the removal of solid remains and do not offer a solution for the removal and recovery of excess liquid remains.

BRIEF SUMMARY OF THE INVENTION

In view of the problems of the prior art specified and discussed above, an object of the present invention was to provide a method for coating the inside of a continuously extruded hollow profile strand which can be carried out largely continuously. The previously described discontinuous reworking steps that are made necessary by the remaining excess coating agent were to be reduced.

An object of the invention was also to provide a method with which the offcuts from the hollow profile caused by visible or crystalline coating remains can be avoided as far as possible.

Similarly, the greatest possible proportion of excess coating agent was to be recovered by the method according to the invention. In the case of the previous technique, large amounts of the coating agent occur as waste with the offcuts from the hollow profile and cannot be recovered.

These objects and others which, though not specifically stated, can be deduced as self-evident from the matters discussed herein, or inevitably arise from them, are achieved by a method as claimed in claim 1.

Expedient modifications of the method according to the invention are afforded protection in the subclaims related back to claim 1, claims 2 to 11. Claims 12 and 13 relate to a liquid wiper and a device for removing excess coating agent from the chambers of a hollow profile, with which the method according to the invention can be carried out.

DETAILED DESCRIPTION OF THE INVENTION

The fact that excess coating agent is wiped from the inner walls by liquid wipers mounted inside the hollow chambers, by the hollow profile strand being moved continuously in relation to the liquid wipers, the liquid wipers, which comprise at least one magnet or magnetizable material and a wiping lip that touches the inner walls and are arranged in the region of the rise in the path of the hollow profile downstream of the supply of coating agent, being securely held at a constant position within the path of the hollow profile strand by counter magnets or magnetizable materials, which are fixed next to the outer side of the continuous hollow profile strand, accomplishes the effect that the coating of the inside of the hollow profile strand can be carried out continuously and the discontinuous subsequent treatment steps described in the prior art for the removal of excess coating agent can be eliminated.

Furthermore, visible or crystalline coating remains in the hollow chambers after drying, and offcuts from the hollow profile produced as a result, are avoided.

By the method according to the invention it is also possible to reduce the consumption of liquid coating agent appreciably. For instance, the consumption is merely one twelfth of the consumption in the method according to EP 0 530 617 A1. This is equivalent to saying that the supply of coating agent lasts twelve times longer in comparison with the method given there.

The method according to the invention is described below in one particular embodiment, without any restriction being intended as a result.

In the first step, in an extrusion system, including an extruder, an extrusion slot die and a cooled calibrator, a hollow profile strand is continuously drawn off at a uniform rate after cooling, in the case of plastics preferably to below the glass transition temperature.

For the purposes of the invention, hollow profile strands are taken as meaning extruded strands with a constant profile which contain at least one continuous hollow space. These include pipes and frame profiles, glazing-bar profiles and other technical profiles with more or less complicated cross-sectional shapes and, if appropriate, a number of hollow spaces. The wall thickness of the layer enclosing the hollow space is generally 0.1 to 5 mm. A precondition for processability by the method of the invention is an elastic flexibility of the extruded hollow profile in the direction of extrusion, which in the case of plastics, for example, allows bending radii of approximately 1 to 100 m, at least at temperatures lying just below the glass transition temperature. Such flexibility is generally obtained if the hollow profile is not thicker than 40 mm.

Figure 4:
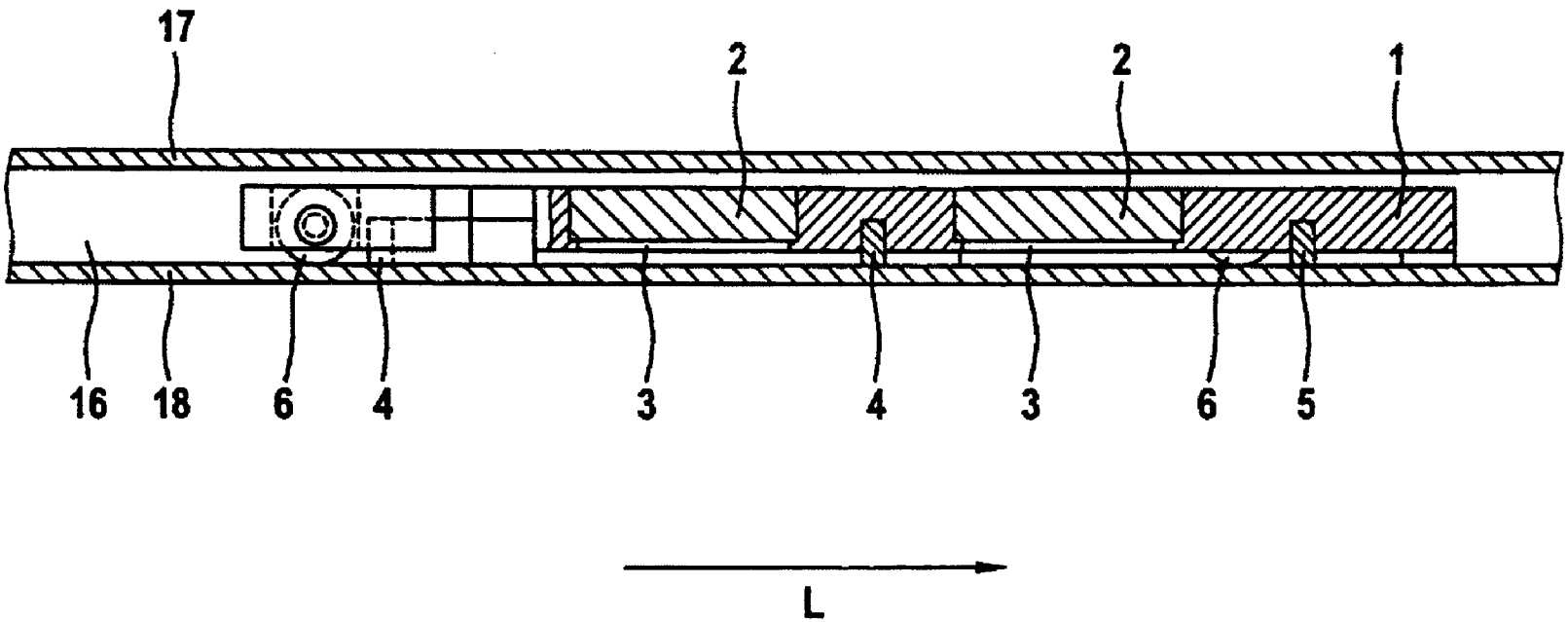
FIG. 4 shows a liquid wiper as it is mounted in a hollow chamber.

Preferably, twin-wall sheets are produced and coated. FIG. 4 shows the preferred form of a hollow profile strand as produced by the method according to the invention in a cross-sectional view.

All elastic materials which allow the necessary bending, as well as thermoplastically extrudable polymers with a modulus of elasticity of at least 1000 MPa, measured at 200° C. to DIN 53457, preferably 1500 to 4000 MPa, are suitable for the method of the invention. Their glass transition temperature (DIN 7724) is at least 50° C., preferably 70 to 200° C. Typical construction plastics for the building trade, which are distinguished by hardness and rigidity and also by resistance to weathering effects, are preferred. For example, polymethyl (meth)acrylates, polycarbonates, polyvinyl chloride, polystyrene, ABS, unvulcanized rubbers, silicones, vulcanized rubber, cork, glass-fiber reinforced or carbon-fiber reinforced plastics and metals are preferred. The notation (meth)acrylate means here both methacrylate, such as for example methyl methacrylate, ethyl methacrylate etc., and acrylate, as well as mixtures of the two.

Polymethyl (meth)acrylates are generally obtained by radical polymerization of mixtures which contain methyl (meth) acrylate. These mixtures generally contain at least 40% by weight of methyl (meth)acrylate, preferably at least 60% by weight and with particular preference at least 80% by weight, in relation to the weight of the monomers.

Comonomers may also be used. The comonomers are generally used in an amount of 0 to 60% by weight, preferably 0 to 40% by weight and with particular preference 0 to 20% by weight, in relation to the weight of the monomers, it being possible for the compounds to be used individually or as a mixture.

The poly (meth)acrylate may comprise further polymers to modify the properties. These include, inter alia, polyacrylonitriles, polystyrenes, polyethers, polyesters, polycarbonates and polyvinyl chlorides. These polymers may be used individually or as a mixture, it also being possible to use copolymers which can be derived from the aforementioned polymers.

The thermoplastic polymers for the production of the hollow profile strand may contain customary additives/additions of all kinds. These include, inter alia, dyes, antistatic agents, antioxidants, mold release agents, flame retardants, lubricants, flow improvers, fillers, light stabilizers and organic phosphorus compounds, such as phosphites or phosphonates, pigments, antiweathering agents and plasticizers.

According to one particular aspect of the present invention, the thermoplastic polymer may, if appropriate, be made mechanically more stable by incorporating an impact modifier.

This is the case in particular if poly(meth)acrylates or polycarbonates are used.

As it runs through the extrusion system, the hollow profile strand of elastic material, with preference of thermoplastic polymer, is guided under elastic flexure through a downwardly curved arcuate path. Firstly, the strand is guided downward, the maximum angle of drop, measured in relation to the horizontal, preferably being between 3° and 20°, in particular between 5° and 10°. After passing the lower vertex, the hollow profile strand is guided upward, preferably rising at an angle, measured in relation to the horizontal, of at most 3° to 20° and in particular at an angle of 5° to 10°. Following the rise, the strand can again be guided substantially horizontally for cooling, preferably as far as a cutting device, where it is divided into portions or twin-wall sheets of a desired length.

The difference in height between the extrusion die and the lower vertex of the path is preferably between 200 mm and 600 mm, with particular preference 350-450 mm. The difference in height between the lower vertex and the horizontal portion of the path following the rise is preferably between 200 mm and 600 mm, with particular preference 300 mm-400 mm. Accordingly, the radius of curvature of the path is between 4000 mm and 26,000 mm. The advancing rate of the hollow profile strand is generally between 0.2 and 2.5 m/min and preferably between 0.5 and 1.5 m/min.

In the region of the lower vertex of the path, there is in the hollow chambers a supply of liquid coating agent which remains stationary in its location. It is always kept up to an amount great enough for the liquid level to touch the inside of all the walls of the hollow chamber.

The coating agent is first filled into the hollow chamber once a sufficiently long piece of the hollow profiled sheet has been extruded and guided through the path. Normally, one filling is sufficient for an operating period of several hours to days.

The advantageousness of an inside coating arises from the respective application area of the hollow profile. For example, it was proposed in EP-B 201 816 to provide a twin-wall sheet of plastic on the outside and inside with a coating of a lower optical refractive index than that of the plastic. As a result, reflection losses of the light passing through are reduced and the overall light transmission is increased.

A preferred application of the method according to the invention is that of applying a water-spreading coating to the inside surfaces of twin-wall sheets. The necessity for such a coating arises in the case of glazings of greenhouses and other humid enclosures.

Coating agents for this purpose are known for example from EP-B 149 182.

However, it must not go unmentioned that it is also possible by means of the invention, if required, for a number of layers to be applied one after the other by the twin-wall sheet being passed through a number of coating zones designed in the way provided by the invention one after the other. A precondition is that the first coating can be cured before the sheet enters the second coating zone. In this way it is possible, for example, for an adhesion-promoting primer to be created for the second coating.

Low-viscosity coating agents with a viscosity in the range from 1 to 4000 mPas, preferably 2 to 25 mPas, are generally used for the method of the invention, it being possible to add solvents to the coating agent. In principle, high-viscosity coating agents can also be used.

What is important is satisfactory wetting of the surface of the plastic by the liquid coating agent, so that a continuous film is formed. If this is not the case, a wetting agent may be added. In most cases, a physically drying liquid coating agent is used, which comprises a dissolved, dispersed or suspended non-volatile or low-volatility coating agent and a volatile liquid. Water-spreading and optically effective coatings and their production are described in EP 0530617. Furthermore, all coating agents with suitable viscosity, such as for example oils, paints etc., can be used with the method according to the invention.

The method of the present invention is characterized in that excess liquid coating agent is wiped from the inner walls of the hollow chambers by liquid wipers which are located inside the hollow chambers.

For the purposes of the present invention, excess means the amount of coating agent that exceeds the amount required for the continuous formation of a film on the inner walls of the hollow chambers.

The amount depends, inter alia, on the viscosity of the coating agent, the extrusion rate and the angle at which the strand is advanced. The amount of excess coating agent is generally 5-98% by volume and, in the more specific case, 20-97% by volume of the total amount used.

The wiping lip preferably consists of TEFLON™, also known as polytetrafluoroethylene (PTFE), or silicone. Expanded TEFLON™, also known as expanded polytetrafluoroethylene (ePTFE), which has a density of between 0.3 and 1.8 g/cm3, is particularly suitable. Furthermore, a silicone tube is particularly suitable as the material for the wiping lip.

There is preferably a liquid wiper for wiping off excess coating agent in each of the continuously extruded hollow chambers. However, it is not absolutely necessary to arrange a liquid wiper in each hollow chamber. Similarly, it is possible to arrange wipers only in a selection of hollow chambers from which excess coating agent is to be removed.

Similarly, it is possible to arrange two or more liquid wipers in a single hollow chamber. These may be arranged both next to one another and one behind the other and optionally be connected to one another. A number of liquid wipers may be arranged in such a way that they wipe coating agent from different walls of the hollow chamber.

The wiping lip of each liquid wiper is arranged in such a way that it touches one or more inner walls of the hollow chamber. Excess liquid is wiped from the inner walls which are touched by the wiping lip by the extruded hollow profile strand being advanced continuously on its path.

Suitable in principle as materials for the wiping lip are those which are chemically resistant to the coating agent, have low friction, in order to provide uniform advancement of the liquid wiper, are adaptable to the shape of the twin-wall profile and at the same time are elastic enough for the adaptation to a changed chamber profile to be possible.

The wiping lip preferably consists of Teflon or silicone. Expanded Teflon, which has a density of between 0.3 and 1.8 g/cm, is particularly suitable. Furthermore, a silicone tube is particularly suitable as the material for the wiping lip.

During the wiping, the liquid wiper and the wiping lip are kept stationary in their location by the interaction between a magnet and a counter magnet or magnetizable materials, while the twin-wall strand moves. The magnet or magnetizable body is part of the liquid wiper and is likewise located inside the hollow chamber.

At least one magnet, counter magnet or magnetizable body per liquid wiper is fixed next to the outer side of the continuous hollow profile strand and keeps the liquid wiper in a substantially constant position within the path of the hollow profile strand. The liquid wiper inside the hollow profile strand is kept in its position by the magnet, counter magnet or magnetizable body outside the strand without touching it. The magnet, counter magnet or magnetizable body is preferably fixed next to the hollow profile strand in such a way that the distance between the surface of the magnet and the outer side of the strand is between 2 mm and 10 mm. Furthermore, magnets, counter magnets or magnetizable bodies may be fixed opposite one another on both sides of the hollow profile strand and keep a liquid wiper stationary in its location.

The geometry of the magnets, counter magnets or magnetizable bodies is appropriately made to match the geometry of the hollow profile. If a hollow profiled sheet is produced, as shown FIG. 3, flat magnets are preferably used, the flat surfaces of which are aligned in the longitudinal and transverse directions parallel to the outer walls of the continuous strand.

The magnets are selected in dependence on the friction coefficients of the liquid. Suitable for the use according to the invention are magnets which have an energy density of between 200 and 380 kJ/$m^3$. A precondition is a magnetic field which is strong enough for the counter magnet or magnetizable body to keep the liquid wiper in its position during the movement of the hollow profile strand. In this case, the hollow profile strand preferably moves at a rate of 0.5-2.5 m/min. Preferably used as magnets and counter magnets are Nd—Fe—B magnets, which have an energy density that is 10 to 12 times higher than conventional iron magnets. Apart from neodymium-iron-boron magnets, in principle any other magnets that have a comparable energy density can also be used. In this case, electromagnets can also be used. Instead of magnets, magnetizable materials in combination with permanent magnets or electromagnets are suitable for the method according to the invention.

Liquid wipers and counter magnets or magnetizable bodies are located in the region of the rise of the path of the hollow profile following the supply of coating agent. The rise in this portion of the path is preferably between 5° and 10°.

Liquid wipers and counter magnets or magnetizable bodies are stationary in their location with respect to the supply of coating agent and the extrusion system during the method, while the hollow profile strand is continuously in motion. The arrangement in the region of the rise of the path has the effect that the wiped coating agent flows back into the supply of coating agent and is available for the further coating process.

In a preferred embodiment of the method, a liquid wiper which comprises not only the described wiping lip and the magnet but also a lip of a material which can be impregnated with the coating agent is used.

Such a lip is located downstream of the wiping lip in the direction of the path of the hollow profile strand and, like said wiping lip, touches one or more inner walls of the hollow chamber. During the process sequence, the lip is impregnated with liquid coating agent and therefore brings about a particularly uniform distribution of the coating agent on the inner walls of the hollow chamber.

Similarly, the lip impregnated with coating liquid brings about the continuous formation of a coating film on the inner walls of the hollow chamber, if at points of the inner walls the coating agent is completely wiped off by the wiping lip.

A preferred material for the liquid-impregnatable lip is felt. Similarly suitable in principle for such a lip are all other liquid-impregnatable materials, such as for example sponges and woven fabrics, that are substantially chemically resistant to the coating agent, have a low friction, in order to provide uniform motionlessness of the liquid wiper, are adaptable to the shape of the twin-wall profile and at the same time are elastic enough for the adaptation to a changed chamber profile nevertheless to be possible.

In principle, a liquid wiper which only comprises the magnet, counter magnet or magnetizable material and the wiping lip can be used. In this case, the magnet, counter magnet or magnetizable material itself forms the body of the liquid wiper, to which the wiping lip is fastened. Used with preference, however, is a liquid wiper which is formed by a non-magnetic body to which the magnet, counter magnet or magnetizable material, the wiping lip and, if appropriate, also a liquid-impregnatable lip are fastened.

The non-magnetic body of the liquid wiper may in principle consist of a material that is substantially inert to the coating agent. Preferred materials are plastics such as poly (meth)acrylate, polystyrene, polycarbonate.

In one embodiment, the method according to the invention is devised in such a way that the inner wall of the hollow chamber is touched exclusively by one or more wiping lips and, if appropriate, additionally by a liquid-impregnatable lip. This is achieved by the lips that are present projecting beyond the magnet or magnetizable material or the body of the wiper.

The magnet, counter magnet or magnetizable material of the liquid wiper and of the possibly present non-magnetic bodies do not touch the inner walls, since a mechanical effect of these components on the inner wall is undesired because of the possible damage to the coating film.

In a further preferred embodiment, a liquid wiper which has one or more rotatable rollers fastened to its magnetic or non-magnetic body is used. The liquid wiper is mounted in the hollow chamber by means of these rollers. The rollers are arranged in such a way that, as a result of the force of attraction of the magnet or counter magnet, they touch at least the wall of the hollow profile strand that is located between the magnet, counter magnet or magnetizable material of the liquid wiper and the counter magnet. Similarly, however, further inner walls may also be touched by rollers on the liquid wiper.

The rollers may, in principle, consist of any material that is substantially inert to the coating agent. Preferred are plastics, such as for example poly(meth)acrylate, polycarbonate, polystyrene or polyamide.

As a result, the liquid wiper according to the previously described embodiment touches one or more inner walls of the hollow chamber not only with the wiping lip and the possibly present liquid-impregnatable lip but also with the rollers. When there is movement of the hollow profile strand, the rollers are set in rotation.

The rollers act as spacers between the wall of the hollow profiled chamber and the magnet, counter magnet or magnetizable material and the body of the liquid wiper. The defined distance makes it possible to achieve a particularly uniform contact pressure of the wiping lips against the wall and particularly uniform wiping.

By the method described, continuous films are formed on the inner walls of the hollow chamber, the film thickness of which in the moist state is generally between 0.05 μm and 3000 μm and preferably between 2.5 μm and 3.0 μm. After drying of the coating agent, the film thickness is generally between 50 nm and 300 nm and preferably between 60 nm and 160 nm.

The resulting film thickness is dependent on a large number of parameters, some of which are mentioned hereafter. For example, the force of attraction between the liquid wiper and the magnet, magnetizable body or counter magnet plays a role in determining the contact pressure of the wiping lip against the hollow chamber wall.

Similarly, the film thickness and the uniformity of the film depend on which friction, elasticity and adaptability to the shape of the hollow profile the material of the wiping lip has. Furthermore, the film thickness is determined by the density of the felt which is used for the felt lip.

If the body of the liquid wiper is provided with rollers, the distance defined by the rollers from the body to the hollow chamber wall and the maximum compression of the wiping lips defined thereby are of significance for the film thickness.

The invention likewise relates to a liquid wiper, and a device for removing excess coating agent. These are represented in one particular embodiment on the basis of FIGS. 1-4, without intending to restrict the invention to this embodiment.

Figure 1:
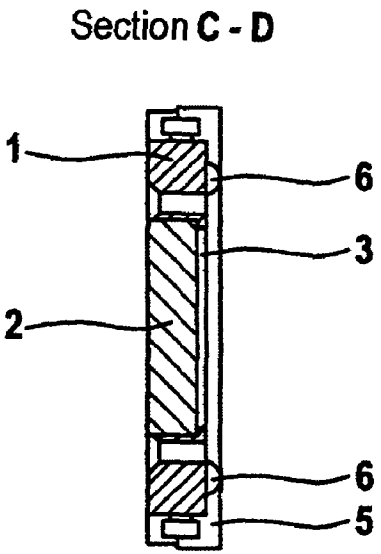
FIG. 1 shows a preferred embodiment of a liquid wiper as used in the method according to the invention.
Figure 1:
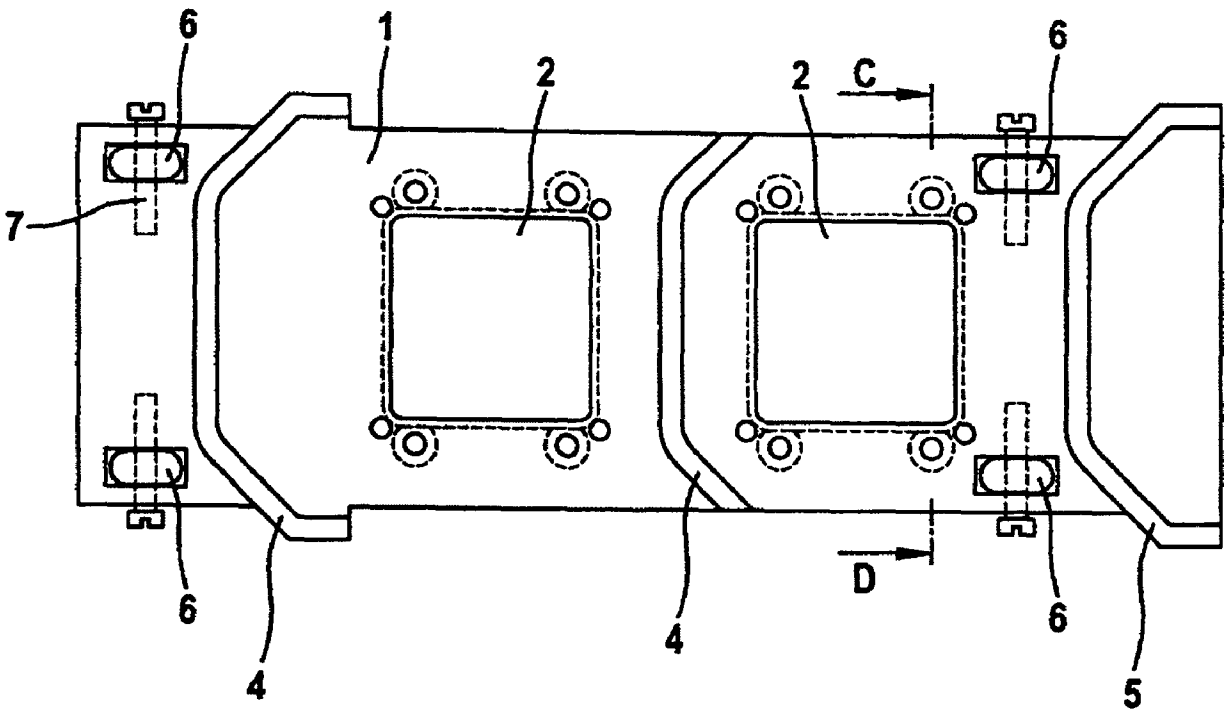

The liquid wiper shown in FIG. 1 comprises a body (1), to which two magnets, counter magnets or magnetizable materials (2) are fastened in recesses (3). Similarly, at least one wiping lip (4) and a felt lip (5) are fastened to the body. Rollers (6) are mounted on spindles (7) in further recesses of the body.

Figure 2:
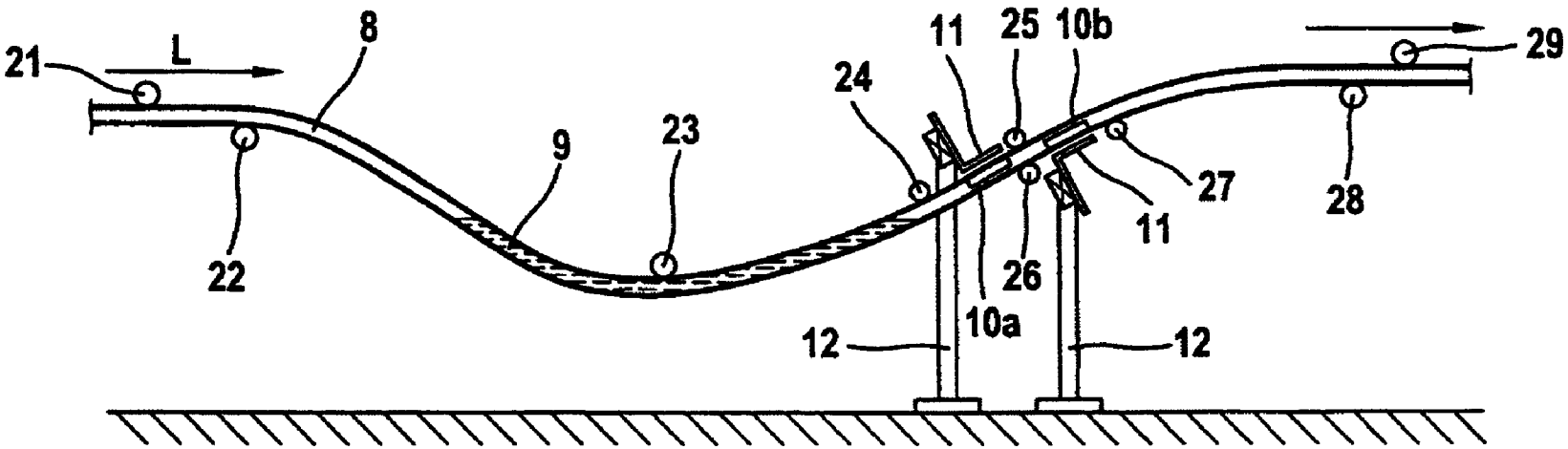
In FIG. 2, a device for carrying out the method according to the invention is represented schematically in a vertical sectional image.

The preferred embodiment of a device for carrying out the method according to the invention is shown in FIG. 2. Arranged after an extrusion device (not represented here) are guiding rollers (21-29), which direct an extruded hollow profile strand (8) onto a downwardly curved arcuate path. In the dip of the path there is a supply of coating agent (9) in the hollow chambers of the strand. Arranged in each of the hollow chambers of the strand are two liquid wipers (10*a*, 10*b*). FIG. 2 shows only one of the hollow chambers in longitudinal section with two liquid wipers arranged therein. Next to the outer sides of the hollow profile strand or the hollow chamber, magnets, counter magnets or magnetizable bodies (11) are fastened to holding devices (12). Liquid wipers, counter magnets, magnets or magnetizable bodies and holding devices are arranged in the rising portion of the path of the hollow profile after the supply of coating agent.

After the rollers (28, 29), the path of the hollow profile runs horizontally. In the horizontal portion, a cutting device (not shown in FIG. 2) for dividing the hollow profile strand into portions or twin-wall sheets of a desired length is arranged.

Figure 3:
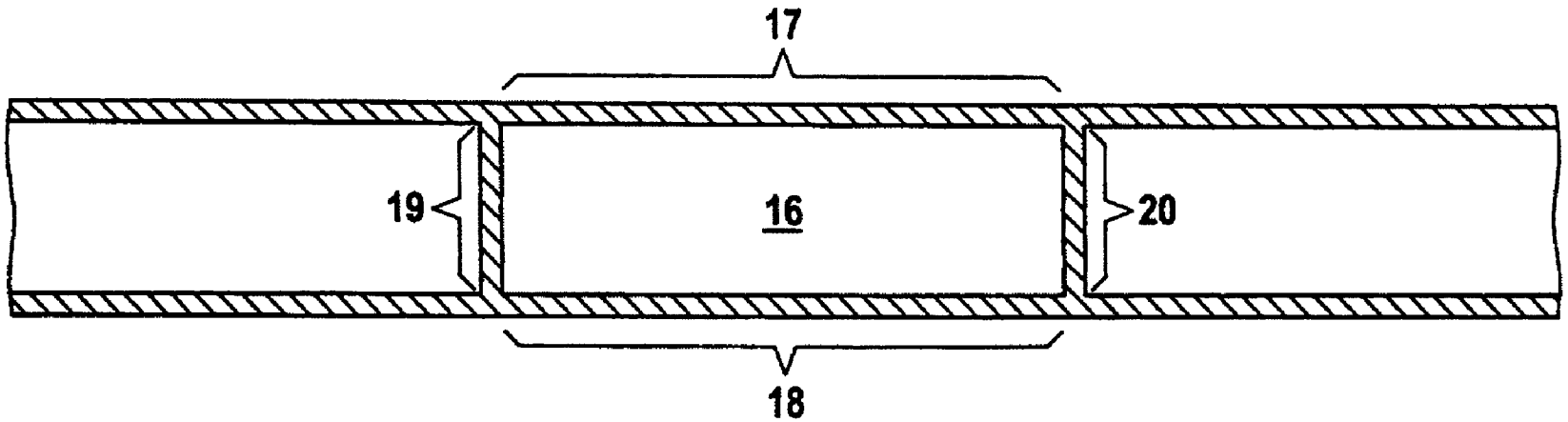
FIG. 3 shows the preferred embodiment of a produced hollow profile strand in a cross-sectional view.

FIG. 3 shows the cross section of the hollow profile, which in FIG. 2 is represented in longitudinal section. It is a twin-wall sheet, in which a hollow chamber (16) is bounded by two flanges (17, 18) and two webs (19, 20). The two liquid wipers (10*a*, 10*b*) respectively lie with their rollers and lips only on one of the flanges, as shown in FIG. 2, and with their lips touch the flange and part of the webs.

Therefore, as shown in FIG. 2, two liquid wipers (10*a* and 10*b*) are arranged in each hollow chamber (16), the first liquid wiper touching with its lips the upper flange (17) and the upper part of the webs (19, 20) and the second liquid wiper touching with its lips the lower flange (18) and the lower part of the webs (19, 20). The first liquid wiper (10*a*) is located upstream of the second liquid wiper (10*b*) in the direction of the path (L) of the hollow profile strand. The two liquid wipers can be connected to each other by a flexible connecting part (not shown in FIG. 2). The connection is therefore flexible, because the hollow profiled sheet is curved in the region of the rise in which both liquid wipers are located and the angle of the rise in relation to the horizontal varies preferably between about 6° and 9°.

FIG. 4 shows the liquid wiper (10*b*) according to FIG. 1 and FIG. 2 in longitudinal section, resting with its rollers (6) and its lips (4, 5) on the lower flange (18) of a hollow chamber.

The way in which the devices and components described above from FIGS. 1-4 function in the method according to the invention is described below.

In a first step, a hollow profile strand is extruded from the extrusion die at a rate of preferably between 0.2 and 5.0 m/min. The strand emerging from the die is guided through between the rollers (21) and (22) and subsequently directed by means of elastic flexure under the lowermost roller (23). After the roller (23), the strand is guided through under elastic flexure between the rollers (24)/(25) and (26)/(27). Finally, the strand is guided through, once again under elastic flexure, between the rollers (28) and (29). The arrangement of the guiding rollers produces an arcuate path of the strand. The roller (23) at the lower vertex of the path acts against the elastic resilience of the strand.

In the region of the lower vertex of the path, there is in the hollow chambers a supply of a liquid coating agent which remains stationary in its location. It is always kept up to an amount great enough for the liquid level to touch the inside of all the walls of the hollow chamber.

By means of a slide, preferably of an optical-fiber cable, two liquid wipers (10*a*, 10*b*) are then pushed into each of the hollow chambers one after the other until they are positioned next to the magnets, counter magnets or magnetizable bodies (11) and are kept stationary by the latter.

After emerging from the extrusion die, the continuously advancing strand firstly runs through the supply of liquid coating agent in the dip of the arcuate path, whereby the inner walls of the hollow chambers (16) are wetted with coating agent. Subsequently, the strand moves past the first liquid wipers (10*a*), which wipe excess coating agent from the upper flange (17) and upper part of the webs (19, 20) of each hollow chamber (16). Wiped-off coating agent consequently flows or drips onto the lower flange of the hollow chambers and flows partly back into the supply of coating agent. Excess coating agent which does not flow off quickly enough and collects on the lower flange (18) and the lower part of the webs (19, 20) is subsequently wiped off by the second liquid wiper and can flow back into the supply.

Once the strand has moved past both liquid wipers, it assumes a substantially horizontal path and can be fed to the cutting device.

The invention claimed is:

1. A method for continuous coating of an inside of a continuously extruded hollow profile strand of elastic material, comprising:

guiding a hollow profile strand on a curved, arcuate path through a supply of a liquid coating agent that remains stationary in a location;

wetting inner walls of hollow chambers of the hollow profile strand with the liquid coating agent, and, directly after running through the supply of the liquid coating agent, guiding the hollow profile strand upward along a rise in the path of the hollow profile strand; and wiping excess liquid coating agent from one or more inner walls of the hollow chambers by liquid wipers mounted inside the hollow chambers, by moving the hollow profile strand continuously in relation to the liquid wipers, wherein the liquid wipers include at least one magnet or magnetizable material and at least one wiping lip that touches only a portion of a cross-sectional perimeter of the inner walls, the liquid wipers being arranged in a region of the rise in the path of the hollow profile strand downstream of the supply of the liquid coating agent and being held at a constant position within the path of the hollow profile strand by counter magnets or magnetizable materials, which are fixed next to an outer side of the continuous hollow profile strand.

2. The method as claimed in claim 1, wherein each of the liquid wipers comprises a body to which the magnet or magnetizable material and the at least one wiping lip are fastened.

3. The method as claimed in claim 1, wherein each of the liquid wipers comprises a magnet or magnetizable body with a wiping lip.

4. The method as claimed in claim 1, wherein Ni—Fe—B magnets are used as the magnet of the liquid wipers and as the counter magnets.

5. The method as claimed in claim 1, wherein the excess liquid coating agent is wiped off by the at least one wiping lip, and the at least one wiping lip includes polytetrafluoroethylene, felt, and/or silicone.

6. The method as claimed in claim 1, wherein the excess liquid coating agent is wiped off by the at least one wiping lip, and the at least one wiping lip includes expanded polytetrafluoroethylene with a density of from 0.3 to 1.8 g/cm$^3$.

7. The method as claimed in claim 1, wherein each of the liquid wipers includes not only the wiping lip including polytetrafluoroethylene or silicone, but also a lip impregnated with coating liquid arranged downstream of the wiping lip in a direction of the path of the hollow profile strand and that touches the inner walls of the hollow chambers.

8. The method as claimed in claim 1, wherein the body of each of the liquid wipers is magnetic or non-magnetic and is mounted in one of the hollow chambers on rotatable rollers fastened to the body.

9. The method as claimed in claim 1, wherein the hollow profile strand comprises a sheet with two outer walls and plural internal webs connecting the outer walls and is extruded, each of the hollow chambers of the hollow profile strand being bounded by two flanges and two webs.

10. The method as claimed in claim 9, wherein first and second liquid wipers are arranged in each of the hollow chambers, the first liquid wiper wiping only an upper flange and an upper part of the webs and the second liquid wiper wiping only a lower flange and a lower part of the webs, and the first liquid wiper being located upstream of the second liquid wiper in a direction of the path of the hollow profile strand.

11. The method as claimed in claim 1, wherein plural layers of one or more coating agents are applied to the hollow profile strand, one after the other.

12. The method as claimed in claim 1, wherein the at least one wiping lip of each of the liquid wipers extends, in a direction substantially transverse to the guiding, from a lateral side of each of the liquid wipers across a bottom side of each of the liquid wipers to an opposite lateral side of each of the liquid wipers, the at least one wiping lip protruding outwardly from the bottom side, the lateral side, and the opposite lateral side to contact the inner walls located adjacent to the bottom side, the lateral side, and the opposite lateral side.

13. The method as claimed in claim 12, wherein, from the lateral side, the at least one wiping lip extends across the bottom side to the opposite lateral side along a substantially U-shaped or substantially frusto-conically shaped path arranged in a direction opposite to a direction of the guiding.

* * * * *